US007644519B2

(12) United States Patent
Su

(10) Patent No.: US 7,644,519 B2
(45) Date of Patent: Jan. 12, 2010

(54) WATERPROOF SHOES WITH THERMOPLASTIC POLYURETHANE (TPU) INSTEPS

(75) Inventor: Robert H. Su, Los Gatos, CA (US)

(73) Assignee: Zhongshan United Shoe Co. Ltd., Zhong Shang, Guong Dong Province (CN)

( * ) Notice: Subject to any disclaimer, the term of this patent is extended or adjusted under 35 U.S.C. 154(b) by 716 days.

(21) Appl. No.: 11/428,349

(22) Filed: Jun. 30, 2006

(65) Prior Publication Data

US 2007/0000151 A1 Jan. 4, 2007

(30) Foreign Application Priority Data

Jul. 1, 2005 (CN) ..... 2005 2 0112243

(51) Int. Cl.
*A43B 13/00* (2006.01)

(52) U.S. Cl. ..... 36/30 R; 36/17 R; 36/12; 36/76 R

(58) Field of Classification Search ..... 36/12, 36/17 R, 22 R, 22 A, 76 R, 72 A, 107, 108, 36/30 R, 30 A
See application file for complete search history.

(56) References Cited

U.S. PATENT DOCUMENTS 3,070,909 A 1/1963 Binder et al.
4,463,505 A * 8/1984 Duclos ..... 36/30 R
5,628,127 A 5/1997 Notzold
5,732,480 A 3/1998 Notzold
5,930,917 A 8/1999 Pavelescu et al.
6,338,205 B2 1/2002 Mitchell et al.
6,637,131 B2 * 10/2003 Lee ..... 36/17 R
6,802,138 B2 * 10/2004 McManus et al. ..... 36/28
7,380,353 B2 * 6/2008 Feller et al. ..... 36/76 R

* cited by examiner

*Primary Examiner*—Marie Patterson
(74) *Attorney, Agent, or Firm*—Intellectual Property Law Group; Juneko Jackson; Otto O. Lee

(57) ABSTRACT

This present invention describes a system of waterproof shoes with thermoplastic polyurethane (TPU) insteps, including vamp, instep and sole, in which the waterproof welt coated with waterproof glue is gummed on the seam between the vamp and the sole; the metal section, instep, mid-sole and inner welt is formed in integration by injecting with TPU polyurethane, in which the outer and inner welts are gummed with glue and sewn firmly with threads on the opposite sides of the instep; a metal piece is put between the thin bottom and the filling materials on the bottom side of the instep. The waterproof methods (the waterproof outer surface of the instep, and the waterproof welt coated with waterproof glue and gummed on the seam between the vamp and the sole reach the purpose of saving the materials and labor, obtaining the waterproof effects which is even better than those of the traditional waterproof shoes and may provide more functionality and better visual effects.

14 Claims, 7 Drawing Sheets

WATERPROOF SHOES WITH THERMOPLASTIC POLYURETHANE (TPU) INSTEPS

FIELD OF THE INVENTION

This present invention relates to kinds of shoe that particularly concern waterproof shoes having a thermoplastic polyurethane (TPU) instep system.

BACKGROUND OF INVENTION

Traditional waterproof shoes are usually made with waterproof materials for the vamp, and the seams are coated with waterproof glue. The inner lining comprises a sock made of waterproof materials. The seams are gummed with waterproof welts and the sock's sole is coated with a waterproof film. The inner lining may, though it is not ideal for the shoe bottom, obtain a good waterproof capacity, but the production procedure is quite complicated, time-consuming, and a waste of manpower. In view of the sewing machine process: firstly, the vamp (19) of the traditional waterproof shoes generally consists of the toe-cap, the back quarter, and the back corner; waterproof glue may be coated at the seams for better waterproof results. Secondly, the waterproof film (26) must be gummed on the sock (20) and the mid-bottom (25) after they are connected to each other, to obtain better results for the sock's bottom. In view of the formation, the production procedure of traditional waterproof shoes is very complicated. As shown in FIG. 1, there are two gaps and one line of needle holes after the vamp (19). The TPU mid-sole (24) is fixed with a steel wire and then sewn with a full line to the outer welt. Water may permeate into the shoe along the seams between the outer welts (21) and the vamp (19); first through the needle holes of the sewing lines (27) on the outer welts, then through the seams between the mid-sole (24) and the vamp (19). The water may not permeate inside the socks, but the comfort degree for wearing the shoes would be seriously affected.

SUMMARY OF THE INVENTION

The purpose of the present invention is to provide kinds of waterproof shoes with a new type of combined waterproof system to avoid the defects of the current process.

For the above-mentioned purpose, the following process scheme shall be used in the present invention.

A kind of waterproof shoe having a thermoplastic polyurethane instep system comprises a vamp, an instep, and a sole. The importance is that the waterproof welt is gummed on the seam between the vamp and the sole and coated with waterproof glue. The metal section, instep, mid-sole and inner welt are formed by integration by injection with polyurethane (PU). The TPU shell and welt are stitched together. The thin mid-sole having a plurality of holes is stitched onto the flange of the welt. The shell with mid-sole attached is put into a mold and material containing PU is poured into the mold to form the outsole. The outer and inner welts are gummed with glue and sewn firmly with threads on the opposite sides of the instep. A metal piece is put between the thin bottom and the filling materials on the bottom side of the instep.

The said inner welts are substantially square-shaped.

The vamp and the top of the instep may be sewed with 18K machine after they are coated with glue.

The whole inner sock (lining) is waterproof in the traditional waterproof shoe. By the present invention, it is charged that the inner sock for the vamp above the instep is waterproof, and the outer surface of the vamp is made of waterproof materials, with their seams being covered with waterproof glue. The outer layer of the instep shall be waterproof. The seams between the vamp and the instep shall be gummed with the waterproof welts and coated with waterproof glue. The said method(s) shall conserve materials and manpower, while obtaining even better waterproof results than those of the traditional waterproof shoe, and may further produce more functionality and better visual effects.

Some specific characteristics of the present invention:

1. The bottom edges of the shoe side and the mid-sole are formed by integration with no seams on the sole bottom, thus increasing the waterproof function.
2. The design for the appearance is creative and innovative, and is a breakthrough from the traditional waterproof shoe.
3. The outer welts are sewn directly to the TPU welts, formed by injection, with threads, which shall be better in tensile strength.
4. The materials of the instep have better grease resistance, acid resistance and alkali resistance than those of the normal rubber. The material also has better bending resistance and is not easily broken.
5. It shows the design idea "regarding the human as the foundation". The embodiment of the present invention is comfortable and safe for wearing in the winter with improved cold resistance, thermal insulation, and wear-and-tear resistance.

These and other embodiments of the present invention are further made apparent, in the remainder of the present document, to those of ordinary skill in the art.

DETAILED DESCRIPTION OF SPECIFIC EMBODIMENTS

Figure 1:
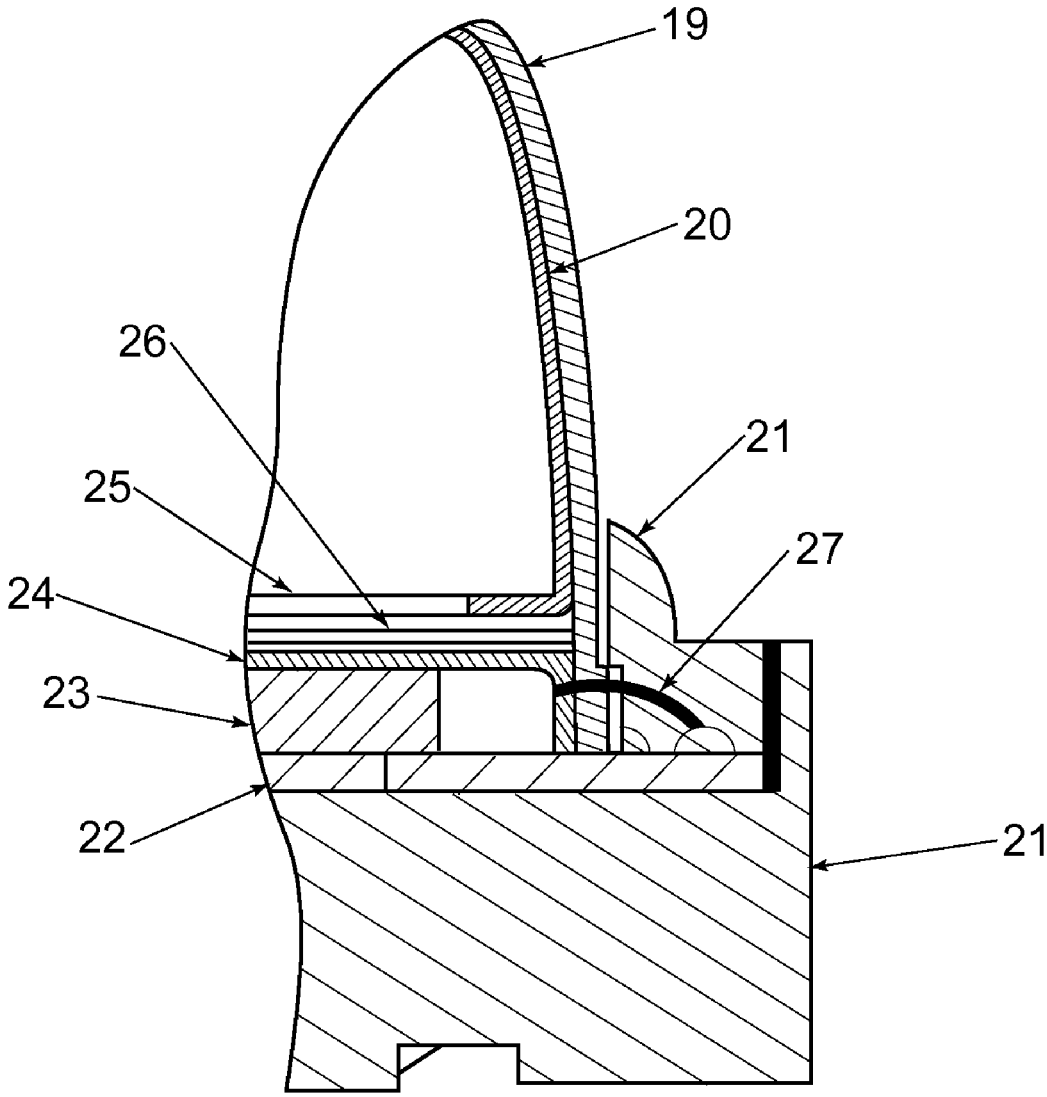
FIG. 1 shows a sectional view of a part of the traditional waterproof shoes.
Figure 2A:
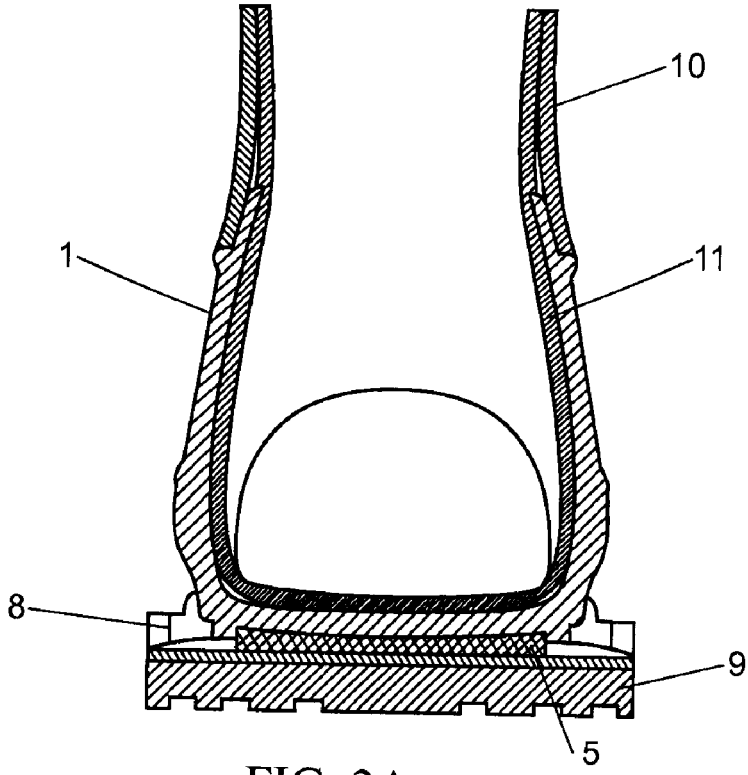
FIG. 2A and FIG. 2B show the sectional views of the front and back parts of the waterproof shoes according to the present invention.
Figure 2B:
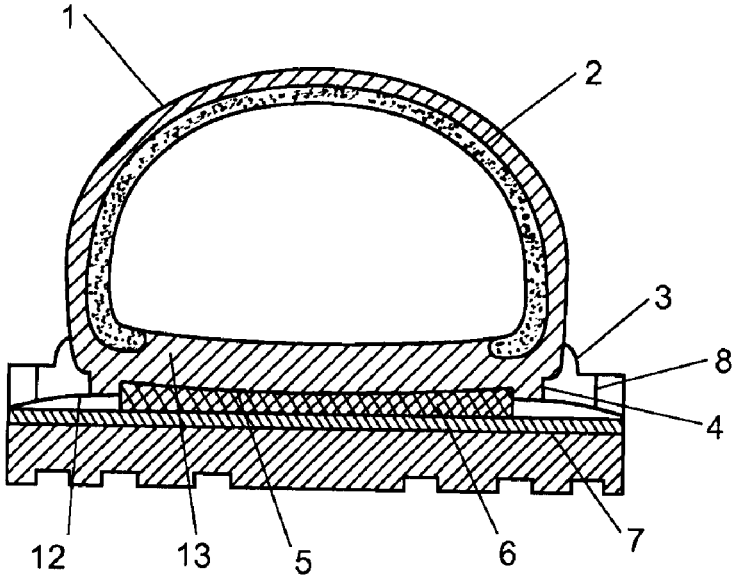
Figure 3:
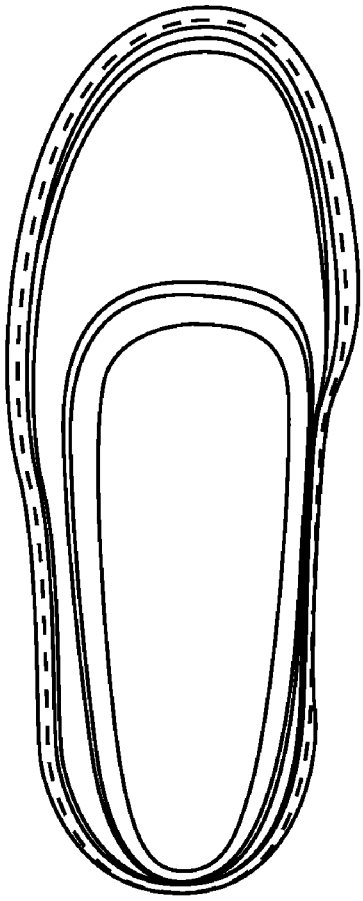
FIG. 3 shows a top view of the instep according to the present invention.
Figure 4:
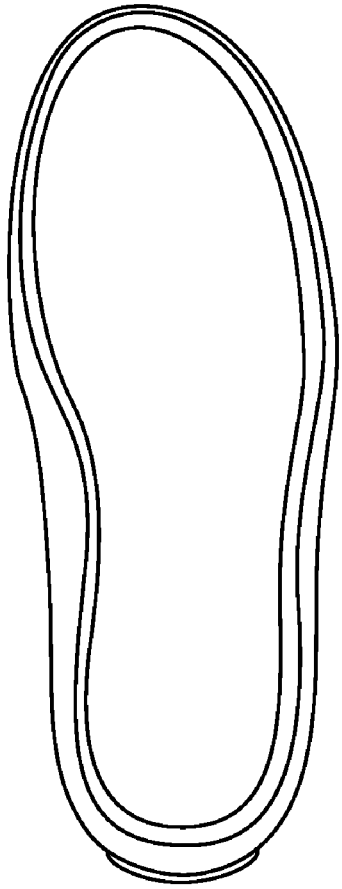
FIG. 4 shows a bottom view of the instep according to the present invention.
Figure 5:
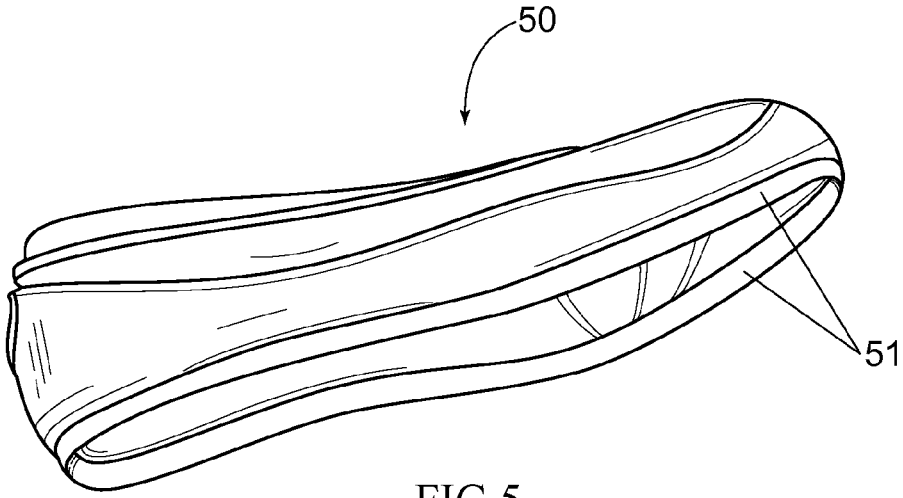
FIG. 5 shows a side view of a shell, according to an embodiment of the present invention.

The structural diagrams of an important part of the detailed description of the present invention are shown in FIG. 2A and FIG. 2B, referring also to FIG. 3 and FIG. 4. The procedure of making said instep of said waterproof shoes comprises of first sewing a vamp (10) to an instep (1) with an 18K machine.

Next, a waterproof welt is gummed onto the sewing seams and coated with a waterproof glue. A sock (11) is then stuck firmly to said vamp (10) and instep (1) by a coating of glue. A metal section (2) is placed within the instep (1) and integrated with mid-sole (13) and the inner welt (12) by injection with TPU. The outer welts (3) and inner welts (12) are gummed on the opposite sides along said instep (1). The outer welts (12) are sewn tightly to said inner welts with the thread (4). Filling materials, such as an EVA (5) are placed under the bottom side of said mid-sole (13). A metal piece (6) and a thin rubber bottom (7) are placed under said filling materials. The thin rubber bottom (7) and the outer welts (3) are sewn tightly to the outer side of the welts with the full line (8). Furthermore, the outsole (9) which may be made of various materials is stuck onto the thin bottom. This method shall obtain better waterproof effects than those of the traditional waterproof shoes, which conforms to the ergonomic principles. Two important points in the production procedure are described below:

(1) The waterproof welts should be stuck on the seams between the instep (1) and the vamp (10), and then coated thoroughly with waterproof glue.

(2) Do not damage the mid-sole when sewing said welts.

Figure 6:
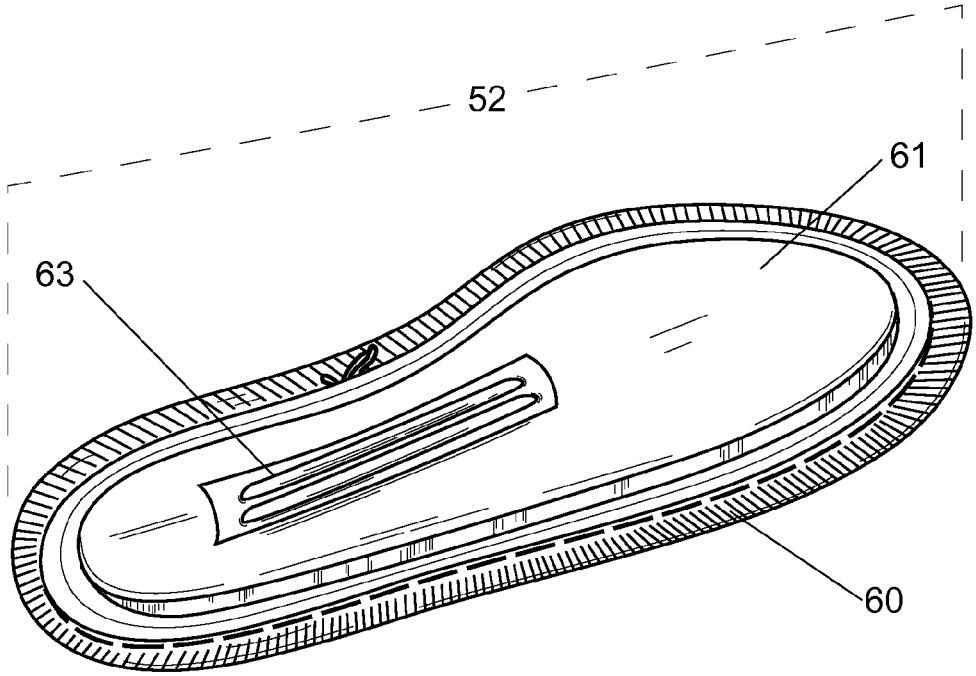
FIG. 6 shows a view of the bottom side of the shell, according to an embodiment of the present invention.
Figure 7:
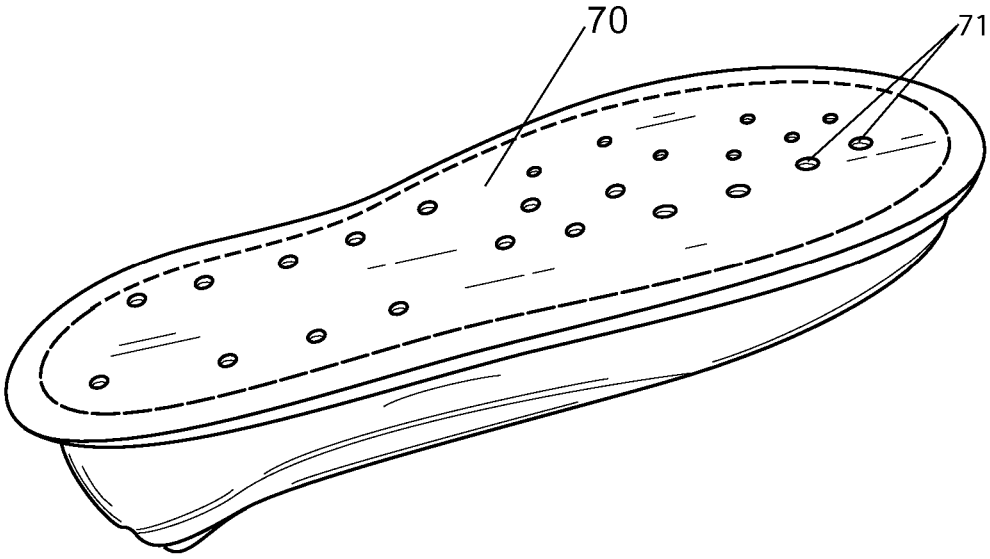
FIG. 7 shows a view of the bottom side of the shell with a mid-sole attached to the flange of the welt, according to an embodiment of the present invention.
Figure 8:
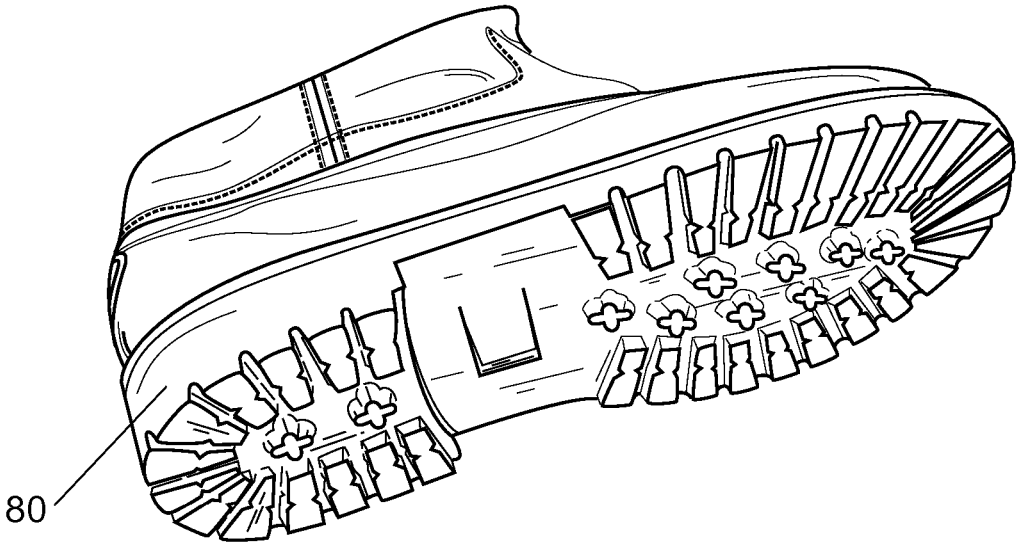
FIG. 8 shows a view of the outsole integrally molded to the shell, according to an embodiment of the present invention.

An embodiment of the present invention is an instep system, as shown in FIGS. 5-9, comprising a shell 50 having a built in ply rib 51 (FIG. 5), a welt 60 (FIG. 6), a filler material 61 to provide support to an article of footwear, a steel shank 63 for stability in a heel area, a mid-sole 70 stitched onto welt 60 (FIG. 7), and an outsole 80 (FIG. 8). Shell 50 comprises an upper portion and a connecting bottom portion. Shell 50 may be made of TPU material. Ply rib 51 is configured about a perimeter of a bottom side of shell 50. Welt 60 is stitched to ply rib 51. Welt 60 may be made from a polyvinyl chloride (PVC) material or other thermoplastic material. Filler material 61 may comprise of Ethylene-vinyl acetate (EVA) or other elastomeric materials. Filler material 61 is cemented into place on an outside bottom portion of shell 50. Steel shank 63 is secured in place on top of filler material 61 at a location about a heel area, as shown in FIG. 6. Mid-sole 70 is attached to a flange of welt 60 to secure filler material 61 and steel shank 63 in place. Mid-sole 70 has holes 71 to allow polyurethane (PU) material to pass through and fill gaps between mid-sole 70 and bottom portion of shell 52.

In an embodiment of the present invention outsole 80 is integrally molded with shell 50, as shown in FIG. 8. Shell 50 is placed in a mold and PU material is poured to form outsole 80. The PU material flows through holes 71 in mid-sole 70 filling the space between mid-sole 70 and bottom portion of shell 52 not occupied by filler material 61.

Figure 9:
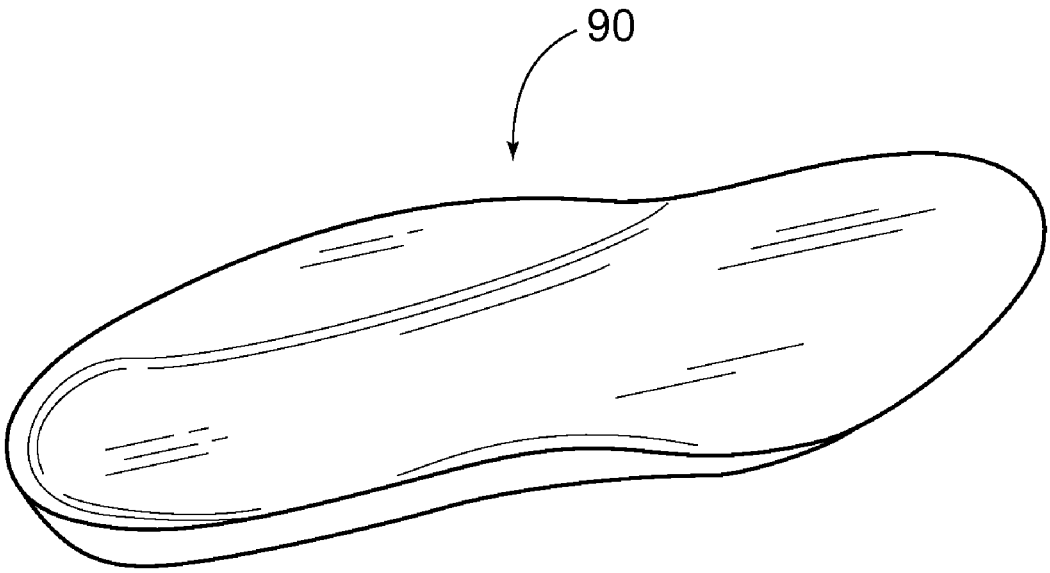
FIG. 9 shows a removable insole, according to an embodiment of the present invention.

In another embodiment, a removable insole 90, as shown in FIG. 9, may be inserted into an interior of shell 50 for added comfort for the user.

Figure 10:
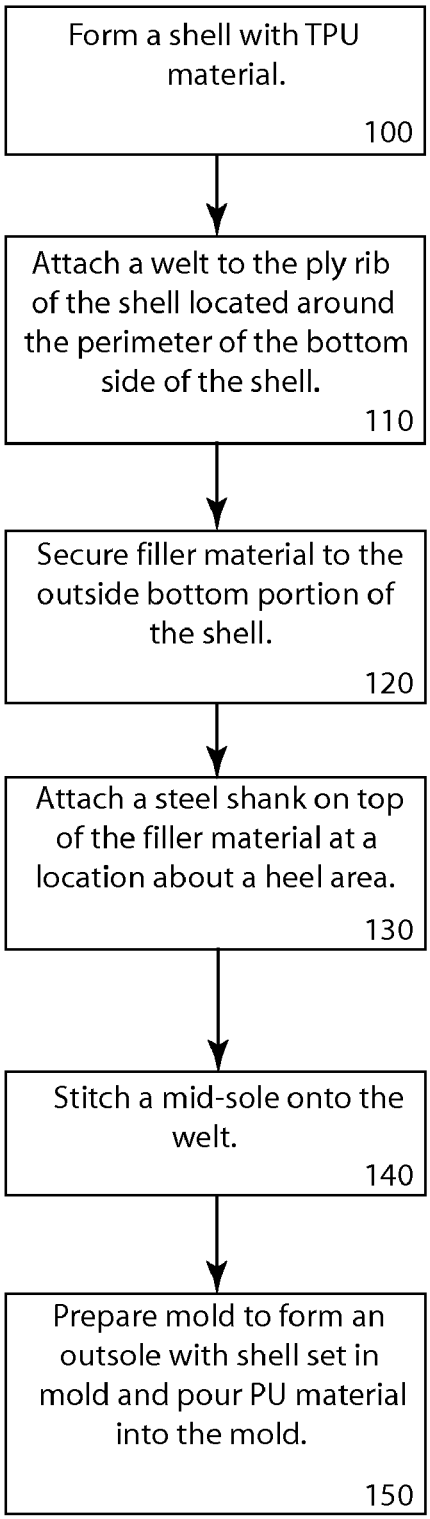
FIG. 10 shows a flowchart depicting a method of making a thermoplastic polyurethane instep system that forms part of a waterproof shoe, according to an embodiment of the present invention.

Another embodiment of the present invention is a method of making an instep system. The method, as shown in FIG. 10 comprises the steps of: forming a shell made of TPU material 100, attaching a welt to the ply rib 110, securing filler material to outside bottom portion of shell 120, attaching steel shank on top of filler material at a location about a heel area 130, stitching mid-sole onto the flange of welt 140, forming outsole by placing shell in a mold and pouring PU material into the mold 150.

Two important points in the production procedure are described below:

(1) The welts are coated thoroughly with waterproof glue.

(2) Care should be taken not to damage the mid-sole when sewing said welts.

In traditional waterproof shoes, the whole of inner socks are the main waterproof part. Now it is changed. In the present invention, the inner socks of the vamp above the instep are the main waterproof part, and the outer vamp is made of waterproof materials. Waterproof glue is coated onto the seams. The outer instep is waterproof for the whole instep part. Waterproof welts are gummed to the seams of the vamp and the insteps, and waterproof glue is coated onto them. Said methods save materials and manpower, and thus obtain even better waterproof results than those of traditional waterproof shoes at a lower cost.

Throughout the description and drawings, example embodiments are given with reference to specific configurations. It will be appreciated by those of ordinary skill in the art that the present invention can be embodied in other specific forms. Those of ordinary skill in the art would be able to practice such other embodiments without undue experimentation. The scope of the present invention, for the purpose of the present patent document, is not limited merely to the specific example embodiments of the foregoing description, but rather is indicated by the appended claims. All changes that come within the meaning and range of equivalents within the claims are intended to be considered as being embraced within the spirit and scope of the claims.

What is claimed is:

1. A thermoplastic polyurethane instep system that forms part of a waterproof shoe comprising:

a shell having a built-in ply rib;

wherein the shell comprises an upper portion and a connecting bottom portion, and the ply rib is configured about a perimeter of a bottom side of the shell;

a welt stitched to the ply rib along the perimeter of the bottom side of the shell;

a filler material fixedly attached onto an outside bottom portion of the shell;

a steel shank secured on top of the filler material at a location about a heel area;

a mid-sole having a plurality of holes;

wherein the mid-sole is attached onto the welt to secure the filler material and the steel shank in place, and the plurality of holes allows a polymeric substance to pass through the mid-sole and fill a gap between the mid-sole and the bottom portion of the shell; and an outsole integrally molded to the shell.

2. The instep system of claim 1, wherein the shell is made up of a thermoplastic polyurethane material.

3. The instep system of claim 1, wherein the welt is made up of a polyvinyl chloride (PVC) material.

4. The instep system of claim 1, wherein the filler material is made up of an Ethylene-vinyl acetate (EVA) material.

5. The instep system of claim 1, further comprising a removable insole inserted into an interior of the shell for added comfort for the user.

6. The instep system of claim 1, wherein the outsole is integrally molded to the shell by a method comprising the steps of:

placing the shell in a mold for forming an outsole; and pouring a material containing polyurethane into the mold, wherein the material flows through the plurality of holes in the mid-sole to fill a gap between the mid-sole and the bottom portion of the shell.

7. A method of making the instep system that forms part of a waterproof shoe of claim 1, comprising the steps of:

forming the shell;

attaching the welt to the ply rib of the shell;

securing the filler material to the outside bottom portion of the shell;

attaching the steel shank on top of the filler material at a location about the heel area;

stitching the mid-sole onto the welt; and forming the outsole, wherein the outsole is integrally molded to the shell.

8. The method of making the instep system of claim 7, wherein the step of forming the outsole further comprises the steps of:

placing the shell in a mold for forming an outsole; and pouring a material containing polyurethane into the mold, wherein the material flows through the plurality of holes in the mid-sole to fill a gap between the mid-sole and the bottom portion of the shell.

9. The method of making the instep system of claim 7, wherein the shell is made up of a thermoplastic polyurethane material.

10. The method of making the instep system of claim 7, wherein the welt is made up of a polyvinyl chloride (PVC) material.

11. The method of making the instep system of claim 7, wherein the filler material is made up of an Ethylene-vinyl acetate (EVA) material.

12. The method of making the instep system of claim 7, further comprising the step of inserting a removable insole into an interior of the shell for added comfort for the user.

13. A thermoplastic polyurethane instep system that forms part of a waterproof shoe comprising:

a shell having a built-in ply rib;

wherein the shell made up of a thermoplastic polyurethane material, has an upper portion and a connecting bottom portion and the ply rib is configured about a perimeter of a bottom side of the shell;

a welt made up of a polyvinyl chloride (PVC) material, stitched to the ply rib along the perimeter of the bottom side of the shell;

a filler material made up of an Ethylene-vinyl acetate (EVA) material, fixedly attached onto an outside bottom portion of the shell;

a steel shank secured on top of the filler material at a location about a heel area;

a mid-sole having a plurality of holes;

wherein the mid-sole is attached onto the welt to secure the filler material and the steel shank in place, and the plurality of holes allows a polymeric substance to pass through the mid-sole and fill a gap between the mid-sole and the bottom portion of the shell; and an outsole integrally molded to the shell, wherein the outsole is integrally molded to the shell by a method comprising the steps of:

placing the shell in a mold for forming an outsole; and pouring a material containing polyurethane into the mold, wherein the material flows through the plurality of holes in the mid-sole to fill a gap between the mid-sole and the bottom portion of the shell.

14. A shoe structure, which forms at least part of a shoe, comprising:

a shell having a built-in ply rib;

wherein the shell comprises an upper portion and a connecting bottom portion, and the ply rib is configured about a perimeter of a bottom side of the shell;

a welt stitched to the ply rib along the perimeter of the bottom side of the shell;

a filler material fixedly attached onto an outside bottom portion of the shell;

a steel shank secured on top of the filler material at a location about a heel area;

a mid-sole having a plurality of holes;

wherein the mid-sole is attached onto the welt to secure the filler material and the steel shank in place, and the plurality of holes allows a polymeric substance to pass through the mid-sole and fill a gap between the mid-sole and the bottom portion of the shell; and an outsole integrally molded to the shell, wherein the outsole is integrally molded to the shell by a method comprising the steps of:

placing the shell in a mold for forming an outsole; and pouring a material containing polyurethane into the mold, wherein the material flows through the plurality of holes in the mid-sole to fill a gap between the mid-sole and the bottom portion of the shell.

* * * * *